US007222439B2

(12) United States Patent
Paintner

(10) Patent No.: US 7,222,439 B2
(45) Date of Patent: May 29, 2007

(54) METHOD FOR OPERATING AN APPLIANCE COMPRISING AT LEAST ONE SUB-PROGRAM STEP DRYING

(75) Inventor: Kai Paintner, Adelsried (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 0 days.

(21) Appl. No.: 10/564,432

(22) PCT Filed: Jul. 8, 2004

(86) PCT No.: PCT/EP2004/007523

§ 371 (c)(1),
(2), (4) Date: Jan. 10, 2006

(87) PCT Pub. No.: WO2005/015103

PCT Pub. Date: Feb. 17, 2005

(65) Prior Publication Data

US 2006/0168840 A1 Aug. 3, 2006

(30) Foreign Application Priority Data

Jul. 30, 2003 (DE) ..... 103 34 796

(51) Int. Cl.
*F26B 21/06* (2006.01)

(52) U.S. Cl. ..... 34/73; 34/595; 34/601

(58) Field of Classification Search ..... 34/380, 34/443, 449, 73, 595, 601
See application file for complete search history.

(56) References Cited

U.S. PATENT DOCUMENTS 3,218,730 A * 11/1965 Menk et al. ..... 34/527
5,724,750 A * 3/1998 Burress ..... 34/267

FOREIGN PATENT DOCUMENTS

| | | |
|---|---|---|
| DE | 30 21 746 | 12/1981 |
| DE | 198 13 924 | 9/1999 |
| EP | 1 344 487 | 9/2003 |
| FR | 1 368 101 | 7/1964 |
| GB | 2 094 961 | 9/1982 |

* cited by examiner

*Primary Examiner*—S. Gravini
(74) *Attorney, Agent, or Firm*—Russell W. Warnock; Craig J. Loest

(57) ABSTRACT

The invention relates to a method for operating an appliance comprising at least one sub-program step "drying", which permits appliances comprising at least one sub-program step "drying" to be operated in the most economic manner possible and permits the efficient drying of items with a minimum energy consumption. To achieve this, during the sub-program step(s) "drying", air is conducted from a treatment chamber via a conduit system, in which at least one Peltier element is located, and the air is then recirculated to the chamber. During its passage through the conduit system, the air is cooled, moisture is removed and the air is subsequently reheated.

6 Claims, No Drawings

METHOD FOR OPERATING AN APPLIANCE COMPRISING AT LEAST ONE SUB-PROGRAM STEP DRYING

The invention relates to a method for operating an appliance comprising at least one sub-program step "drying", such as is applied for example in laundry driers, dishwashers, crockery driers, shoe driers etc.

Various methods are known for drying, for example, items to be washed in a dishwasher. For example, the objects to be washed can be dried by own-heat drying if the rinsing liquid is heated in a partial program step "clear rinse" and thus the objects to be washed which have undergone a hot clear rinse are dried by themselves by the self-heat of the objects to be washed which has thus built up during the drying process. In order to achieve this own-heat drying, the rinsing liquid is heated to a certain temperature in the "clear rinse" partial program step and applied to the objects to be washed by means of spraying devices. As a result of the relatively high temperature of the rinsing liquid in the "clear rinse" partial program step of usually 65° C. to 75° C., it is achieved that a sufficiently large quantity of heat is transferred to the objects to be washed so that water adhering to said objects to be washed vaporises as a result of the heat stored in the objects to be washed.

In a further known method for drying items to be washed in dishwashers, a separate heat source, e.g. a hot air fan, is used to heat the moist air mixture during the drying process so that the air in the washing container can absorb a larger quantity of moisture.

Dishwashers are known in which the moist air is vented outwards. This is disadvantageous since the surrounding kitchen furniture is damaged.

Thus, other methods are known in which the moist air is passed over condensing surfaces on which the moisture condenses before being guided out. This condensation is either passed into the washing container or into special collecting containers.

A method for operating a dishwasher is known from DE 30 21 746 A1, wherein a heat exchanger connected to the washing container in a heat-conducting manner is supplied with cold fresh water during a partial program step "drying". A condensing surface is thereby produced on the inside of the washing container on which moisture condenses and the condensation formed remains in the washing container. Since the temperature difference between the moist air and the fresh water which is poured in, is relatively small, and the quantity of fresh water is heated continuously, this results in the disadvantage that the condensation of the moist air lasts for a long time and continually becomes smaller so that the discharge of moist air from the dishwasher increases and the duration of the partial program step "drying" is long with a moderate drying result.

A disadvantage in the heating systems described above according to the prior art described further above is that the heating of the rinsing liquid is associated with a high energy requirement and the thermal energy required for each heating phase must be produced anew by means of electrical heating elements. The known heating systems also have the disadvantage that the heating of the rinsing liquid in the "clear rinse" partial program step and the processes in the "drying" partial program step are themselves associated with a high energy requirement and the thermal energy required is lost after the drying process.

It is thus the object of the present invention to provide a method which can be used to operate appliances of the type specified initially as economically as possible, to efficiently dry the objects to be dried and to keep the related energy costs as low as possible.

This object is solved by the method according to the invention having the features according to claim 1. Advantageous further developments of the present invention are characterised in the dependent claims.

In the method according to the invention for operating an appliance comprising at least one sub-program step "drying", during the at least one sub-program step "drying" air is conducted from a treatment chamber via a conduit system in which at least one Peltier element is located and said air is then recirculated to this chamber, wherein during its passage through said conduit system the air is cooled, moisture is removed and the air is subsequently reheated.

A Peltier element is a heat pump with which heat is removed from one area, said area being cooled, and transported to another area, said area being heated. As a result of using a Peltier element, substantially less heating of the items to be treated is required compared with the prior art, e.g. in dishwashers in the "clear rinse" partial program step. This means a substantial energy saving. As a result of the cooling of the air, its moisture absorption capacity is lowered and the moisture fraction of the air is precipitated as condensate. As a result of heating of the air, its moisture absorption capacity is increased again on each passage through the conduit system which results in improvement in the drying result and/or a shortening of the drying time. In the closed air system, any exchange of contaminated air from the environment is completely eliminated, preventing any back contamination of the treated objects. The present invention provides a method which can be used to efficiently operate appliances of the type specified initially, to efficiently dry objects to be dried and thus keep the related energy costs as low as possible.

According to a preferred feature of the invention, air is conveyed by means of a fan, thereby facilitating control of the use of the Peltier element.

According to a further preferred feature of the invention, the air is cooled by means of the Peltier element. The actual function of a Peltier element, cooling whilst removing the absorbed thermal energy, is accordingly used in the method according to the invention. As a result of the cooling of the air, its moisture absorption capacity is lowered and the moisture fraction of the air is precipitated as condensate.

According to a further preferred feature of the invention, the air is heated by means of the Peltier element. The further function of the Peltier element, which is provided anyway, the transported heat absorbed during cooling of the moist air and during condensation of the moisture from the moist air, is used for further energy saving.

According to an advantageous embodiment of the invention, the air is heated by means of a heater. Should the heating of the air by the Peltier element not be sufficient, the air is additionally heated by a heater to ensure the drying function. Despite the additional energy consumption for the heating, a saving of energy is achieved compared with the previously described prior art. According to a further advantageous embodiment of the invention, the air is passed by a condenser. Should the removal of moisture from the air by the Peltier element not be sufficient, the air is additionally passed by a condenser which undertakes the lacking removal of moisture to ensure the drying function.

The invention is explained hereinafter with reference to the exemplary embodiment of a method in a dishwasher.

The method according to the invention for operating an appliance comprising at least one sub-program step "drying"

is implemented in the exemplary embodiment explained in a dishwasher. It is known that a dishwasher has a washing method whose program run consists of at least one partial program step "pre-rinse", a partial program step "clean", at least one partial program step "intermediate rinse", a partial program step "clear rinse" and a partial program step "dry". According to the invention, in the exemplary embodiment explained during the at least one partial program step "dry", air is conducted from a treatment chamber via a conduit system in which at least one Peltier element is located and said air is then recirculated to this chamber, wherein during its passage through said conduit system the air is cooled, moisture is removed and the air is subsequently reheated.

In the exemplary embodiment the treatment compartment of the dishwasher, the washing container, is equipped with an outlet in the upper area of the washing container. From this outlet an air conduit leads to a fan and from the fan to the Peltier element.

As is known, a Peltier element is a heat pump which is used to extract heat from one region—this is cooled—and to transport it to another region—this is heated, the heat being guided at high speed and in a large quantity from one part—the so-called "cold side"—of the Peltier element to the other part—the so-called "warm side"—of the Peltier element. Thus, if the moist air is fed to the "cold side" of the Peltier element, this cools the moist air and thus reduces the moisture absorption capacity of the moist air, causing the moisture contained in the moist air to condense. The "cold side" of the Peltier element thus extracts the heat (sensible heat) from the moist air and also absorbs the condensation heat produced (latent heat) and transports the heat to the other part—to the "heating" of the Peltier element.

In the exemplary embodiment a further air conduit leads from the "cold side" of the Peltier element to the "warm side" of the Peltier element and from there to an inlet located in the lower area of the washing container.

If the air now reaches the "warm side" of the Peltier element, the air is now heated by said element.

The heated air fed into the washing container is now substantially drier and thus again has a high absorption capacity for moisture. It rises upwards in the washing container and absorbs the residual moisture on the items to be treated, the objects to be washed. Said air is now fed back to the conduit system as described above.

As a result of using a Peltier element, substantially less heating of the objects to be treated is required compared with the prior art, in the exemplary embodiment described, only by about 50° C. or possibly even lower in the "clear rinse" partial program step in dishwashers. This means a substantial saving of energy. As a result of the cooling of the air, its moisture absorption capacity is reduced and the moisture fraction of the moist air is precipitated as condensate. As a result of the heating of the air, its moisture absorption capacity is increased again on each passage through the conduit system which results in an improvement of the drying result and/or shortening of the drying time. In the closed air system exchange of contaminated air from the environment is completely eliminated, preventing back contamination of the treated items.

Should the removal of moisture from the air as a result of the cooling by the Peltier element not be sufficient, the air is additionally passed by a condenser which undertakes the lacking removal of moisture to ensure the drying function. The condenser can be located in the direction of flow of the air before or after the "cold side" of the Peltier element, in the exemplary embodiment it is located after the "cold side" of the Peltier element.

Should the heating of the air by the Peltier element not be sufficient, the air is additionally heated using a heater to ensure the drying function. In the exemplary embodiment described the heater is located shortly before the inlet of the treated air into the washing container. Despite the additional energy consumption for the heating, a saving of energy is achieved compared with the previously described prior art.

The present invention provides a method which can be used to operate appliances of the type specified initially as economically as possible, to efficiently dry items to be dried and thus keep the associated energy expenditure as low as possible.

The invention claimed is:

1. A method for operating an appliance having a treatment chamber in which items are subjected to washing, rinsing, and drying programs, the method comprising:

(a) performing a wash program for washing of the items:

(b) performing a rinse program for rinsing of the items: and (c) performing a dry program for drying of the items, the dry program comprising guiding air via a conduit system connected to the treatment chamber such that air is initially guided from the treatment chamber to the conduit system and is subsequently recirculated from the conduit system to the treatment chamber with (i) the air that has been guided from the treatment chamber to the conduit system initially being guided relative to a Peltier element having means for extracting heat from air passed therethrough, whereupon the air is cooled by its passage relative to the means for extracting means and, thus, the moisture absorption capacity of the air is reduced, (ii) the air having passed relative to the means for extracting heat subsequently being guided relative to a means for heating the air such that the air is heated, and (iii) the air thereafter being recirculated after such heating by the means for heating the air back to the treatment chamber.

2. The method according to claim 1, wherein the air is conveyed by means of a fan.

3. The method according to claim 1, wherein the air is cooled by means of the Peltier element.

4. The method according to claim 1, wherein the air is heated by means of the Peltier element.

5. The method according to claim 1, wherein the air is heated by means of a heater.

6. The method according to claim 1, wherein the air is passed by a condenser.

* * * * *